US005178522A

United States Patent [19]

Abelen et al.

[11] Patent Number: 5,178,522

[45] Date of Patent: Jan. 12, 1993

[54] METHOD AND APPARATUS FOR SUPPLYING OIL TO A VACUUM PUMP

[75] Inventors: Thomas Abelen, Cologne; Lutz Arndt, Troisdorf; Winfried Kaiser; Peter Müller, both of Cologne; Dieter Vorberg, Erftstadt, all of Fed. Rep. of Germany

[73] Assignee: Leybold Aktiengesellschaft, Hanau, Fed. Rep. of Germany

[21] Appl. No.: 704,351

[22] Filed: May 23, 1991

[30] Foreign Application Priority Data

May 29, 1990 [DE] Fed. Rep. of Germany ..... 4017191

[51] Int. Cl.[5] ..... F04C 29/02

[52] U.S. Cl. ..... 417/410; 418/13; 418/96; 418/98

[58] Field of Search ..... 418/13, 87, 96, 97, 418/98, 84; 417/410

[56] References Cited

U.S. PATENT DOCUMENTS

| | | | |
|---|---|---|---|
| 1,409,868 | 3/1922 | Kien | 418/96 X |
| 1,672,205 | 6/1928 | Eisler | 418/13 |
| 2,062,045 | 11/1936 | Van Deventer | 418/13 X |
| 3,525,578 | 8/1970 | Le Blanc, Jr. | 418/96 X |
| 4,844,702 | 7/1989 | Ceccherni et al. | 418/96 X |

FOREIGN PATENT DOCUMENTS

| | | | |
|---|---|---|---|
| 1190134 | 4/1965 | Fed. Rep. of Germany | 418/96 |
| 1302509 | 7/1962 | France | 418/98 |
| 2489433 | 3/1982 | France | 418/98 |
| 449260 | 6/1949 | Italy | 418/98 |

*Primary Examiner*—Leonard E. Smith

*Attorney, Agent, or Firm*—Spencer, Frank & Schneider

[57] ABSTRACT

A two-stage rotary vane vacuum pump includes a pre-vacuum stage having a pre-vacuum pumping chamber and an outlet valve; a main oil sump; and a first oil conduit having a first opening communicating with the main oil sump and a second opening communicating with the pre-vacuum pumping chamber. The first opening is located at a level below an operational oil level in the main oil sump. There is further provided an intermediate oil sump situated at a level above the outlet valve and being arranged for receiving oil from the pre-vacuum pumping chamber; and a second oil conduit leading from the intermediate oil sump to components of the vacuum pump to be supplied with oil. All such components are situated at a level below the intermediate oil sump.

6 Claims, 3 Drawing Sheets

METHOD AND APPARATUS FOR SUPPLYING OIL TO A VACUUM PUMP

CROSS REFERENCE TO RELATED APPLICATION

This application claims the priority of German Application No. P 40 17 191.4 filed May 29, 1990, which is incorporated herein by reference.

BACKGROUND OF THE INVENTION

This invention relates to a method of and an apparatus for supplying oil to a two-stage rotary vane vacuum pump which has pumping chambers, locations to which oil is to be applied, as well as an oil sump.

In oil-operated rotary vane vacuum pumps, one function of the oil is to provide, in the pumping chambers, a sufficient seal between the suction side and the pressure side. At the same time, the oil serves for lubricating the rotor disposed in the pumping chamber as well as the vanes sliding in the rotor. Further, the circulated oil serves for cooling components, particularly those which rotate in a vacuum. In addition, the oil serves to carry dirt particles into the sump. Also, further bearings of the vacuum pump (rotor bearings, drive shaft bearings and the like) are lubricated with the aid of the oil in the vacuum pump.

It is known to provide rotary vane vacuum pumps with a separate oil pump and to introduce the pressurized oil, delivered by such additional pump, to those locations of the vacuum pump which are to be supplied with oil. Although a sufficient oil supply of such locations is ensured, this solution is complex and expensive because it requires a separate oil pump.

It is further known to utilize the vacuum generated by the pump to deliver the oil. In such a solution, however, problems are encountered with the oil supply of those locations which are not situated immediately at the pumping chamber or which, based on the desired pump output, must not be connected with the pump chamber.

SUMMARY OF THE INVENTION

It is an object of the invention to provide an improved method and apparatus of the above-outlined type wherein the vacuum pump does not need a separate oil pump and yet a sufficient oil supply of all locations is provided.

This object and others to become apparent as the specification progresses, are accomplished by the invention, according to which, briefly stated, the two-stage rotary vane vacuum pump includes a pre-vacuum stage having a pre-vacuum pumping chamber and an outlet valve; a main oil sump; and a first oil conduit having a first opening communicating with the main oil sump and a second opening communicating with the pre-vacuum pumping chamber. The first opening is located at a level below an operational oil level in the main oil sump. There is further provided an intermediate oil sump situated at a level above the outlet valve and being arranged for receiving oil from the pre-vacuum pumping chamber; and a second oil conduit leading from the intermediate oil sump to components of the vacuum pump to be supplied with oil. All such components are situated at a level below the intermediate oil sump.

By virtue of the fact that the oil is supplied by the pre-vacuum stage of the vacuum pump, an oil supply of this pump stage is ensured. Therefrom, the oil is admitted to the intermediate sump which has a greater geodetical height than those locations which have to be subsequently lubricated with oil. The outflow channels leading from the intermediate sump may be troughs which are provided in the components during their casting, bore holes having a relatively large diameter or guide plates, all being entirely insensitive to dirt. Any risk that soiled oil may damage or destroy the pump is thus eliminated. If, in addition, particularly delicate bearings are so structured that the lubricant can never fully flow out therefrom, then emergency running properties are obtained which, in case of no oil supply prevent the pump from suffering "total" damage.

DESCRIPTION OF THE PREFERRED EMBODIMENT

Figure 1:
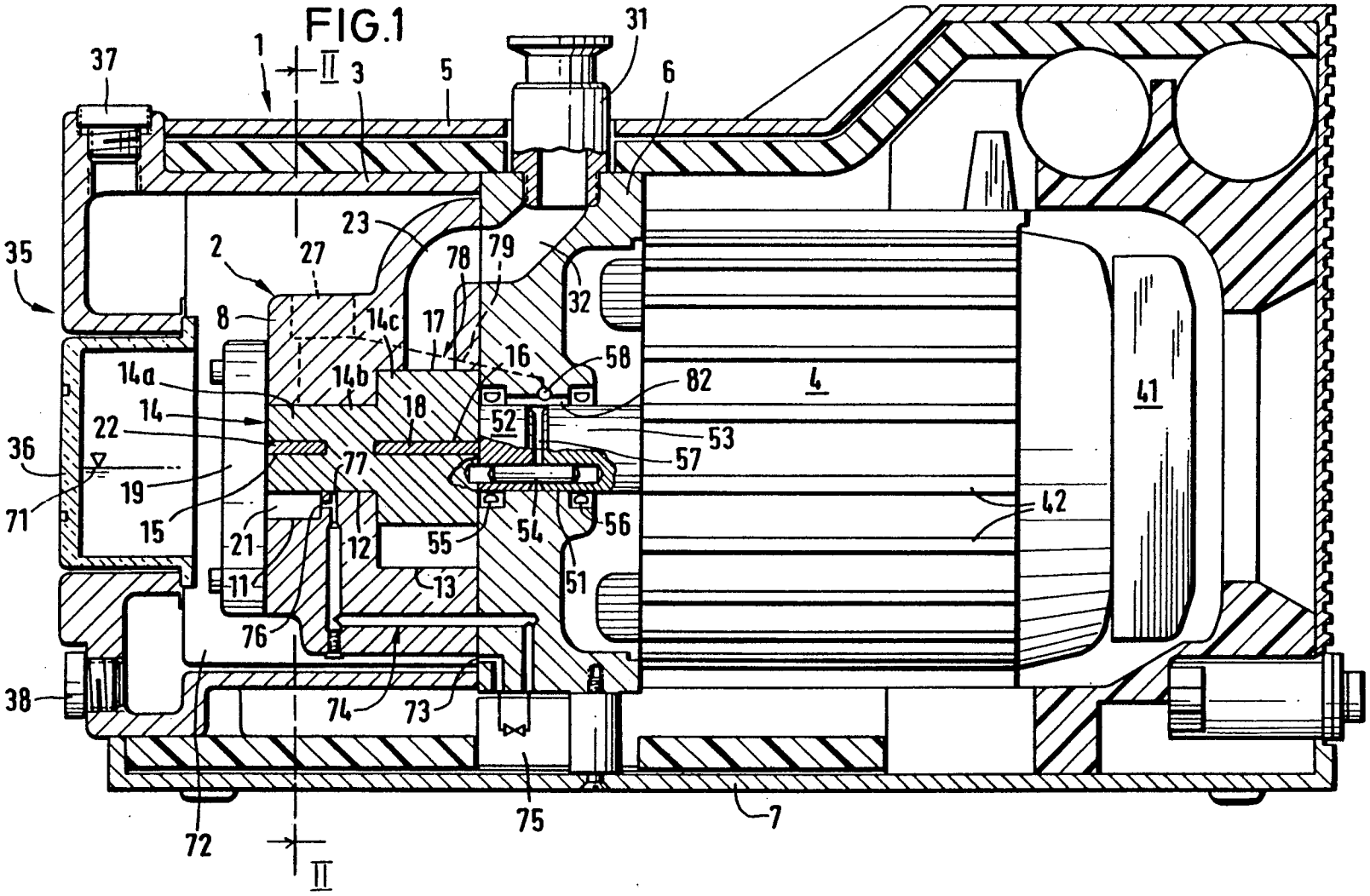
FIG. 1 is an axial sectional view of a preferred embodiment of the invention, taken along line I—I of FIG. 2.
Figure 2:
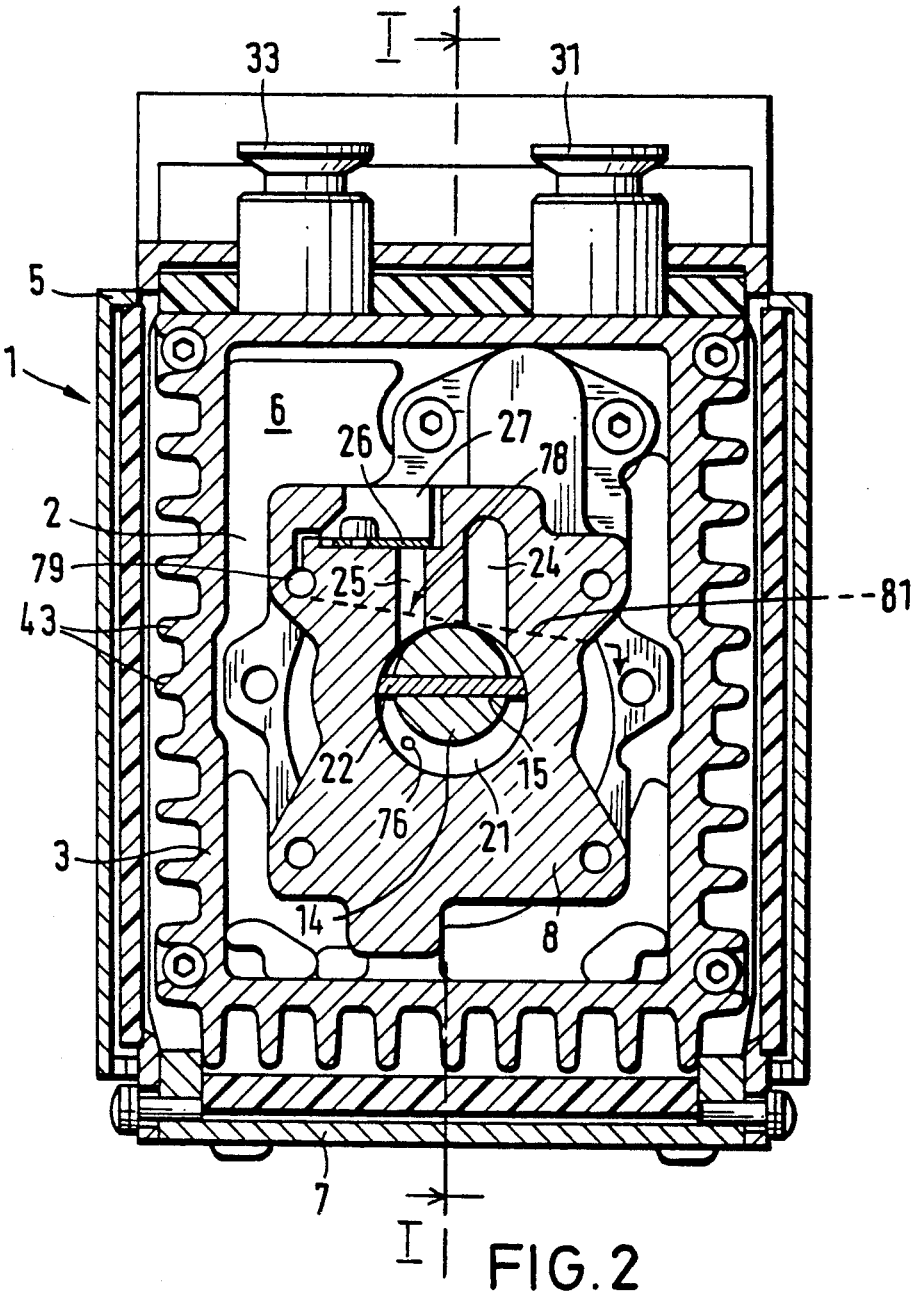
FIG. 2 is a sectional view, taken along line II—II of FIG. 1.

Turning to FIGS. 1 and 2, the two-stage rotary vane vacuum pump shown therein and generally designated at 1 includes a pump housing 2, an oil casing 3 surrounding the pump housing 2, a drive motor 4 and an outer housing or pump cover 5. The pump housing 2 and the drive motor 4 are mounted on a separating shield 6 which, in turn, is secured to a base plate 7 supported on a floor.

The pump housing 2 includes a one-piece pump ring 8 which has a throughgoing opening having three consecutive zones 11, 12 and 13 of different configurations. In the ring opening 11, 12, 13 there is disposed a one-piece rotor assembly 14 which has axially consecutive parts 14*a*, 14*b* and 14*c*. The two outer parts 14*a* and 14*c* are provided with vane slots 15, 16 at their end faces and form the armature of the high vacuum stage (hereafter "HV-stage") and the pre-vacuum stage (hereafter "PV-stage"), respectively.

The mid portion 14*b* of the rotor assembly 14 corresponds in length and diameter to the mid zone 12 of the opening of the pump ring 8 such that this zone functions as a slide bearing for the rotor assembly 14. The opening zone 13 of the pump ring 8 is enlarged relative to the zone 12 and constitutes, together with the shield 6, the pump chamber 17 of the HV-stage in which the rotor part 14*c*, carrying a vane 18, is disposed. The zone 11 of the pump ring 8 constitutes, together with a frontal plate 19, the pump chamber 21 of the PV-stage in which the rotor part 14*a*, carrying a vane 22, is disposed. The HV-stage has an inlet channel 23, and a channel 24 extends from the outlet of the HV-stage to the inlet of the PV-stage. The PV-stage has an outlet channel 25, associated with an outlet check valve 26 which is situated at the upper part of the pump housing 2 and, in case of a pump breakdown, preserves the vacuum in the vessel under evacuation. A depression 27 is provided in the top face of the housing 2 for serving as an intermediate oil sump during the operation of the vacuum pump, as it will be explained later.

An inlet nipple 31 of the vacuum pump is secured to the shield 6 in which a port 32 is provided, connecting the inlet nipple 31 to the inlet channel 23 of the HV-stage. The shield 6 also carries an outlet nipple 33 which is connected by a non-illustrated port that is similar to the port 32, with the inner space of the oil casing 3.

The oil casing 3 has an end face structure 35, whose central portion 36 is transparent and serves for monitoring the oil level in the oil casing 3. The end face structure 35 has an approximately semicircular configuration, whose wide side is oriented towards the oil casing 3. The end face structure 35 extends over the entire height of the oil casing 3 and is provided with an oil filling opening 37 and an oil drain 38.

The motor 4 is provided with a blower 41 at its end face oriented away from the pump structure proper. The cold air flow generated by the blower 41 serves for cooling both the motor 4 and the oil casing 3. The housing of the motor 4 and the oil casing 3 are both provided with axially or horizontally oriented cooling ribs 42 and 43, respectively.

The separating shield 6 further functions as a coupling housing. It has a throughgoing bearing bore 51 rotatably receiving a stub shaft 52 of the rotor system 14 and a stub shaft 53 of the drive motor 4. The two stub shafts 52 and 53 are connected at their radial faces by means of a pin coupling 54. It is to be understood that instead of a pin coupling, interengaging projections in the end faces of the stub shafts 52 and 53 may be provided.

Each stub shaft 52 and 53 is associated with a respective shaft seal ring 55 and 56, seated in the shield 6. The seals 55 and 56 define between themselves a central lubricant chamber 57 which contains the stub shaft coupling 54 that may be fully lubricated through an oil port 58. Since the rotor-side shaft seal ring 55 is situated in the immediate vicinity of the HV-stage, the output of this stage, operated with the above-described reduced lubrication, is not adversely affected by the lubricant.

Figure 3:
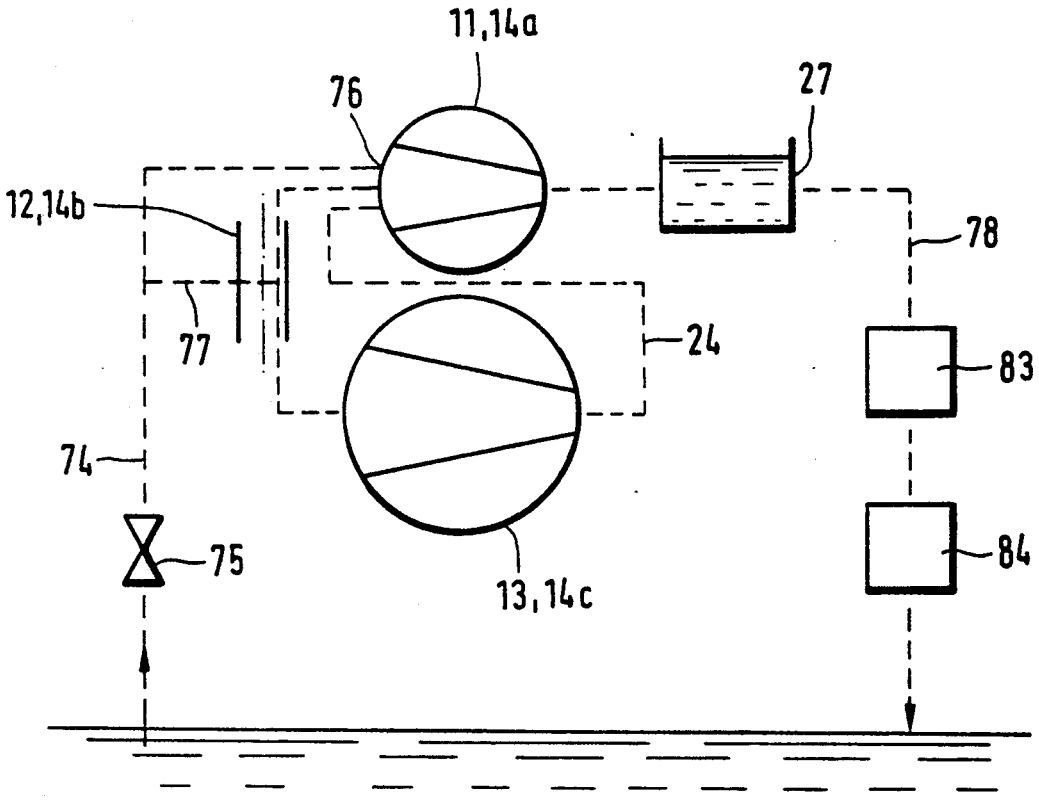
FIG. 3 is an oil circuit diagram illustrating the principle of operation of the invention.

Turning now to a description of the oil circuit designed according to the invention and also referring to FIG. 3, underneath the usual (operational) oil level 71 in the oil casing (main sump) 3 there is situated an inlet opening 73 of an oil conduit or oil channel 74 which leads into the pump chamber 21 of the PV-stage 11, 14*a*.

The oil channel 74 is formed of a plurality of bores provided in the shield 6 and in the pump housing ring 8 which are dimensioned such that they permit the insertion of a solenoid valve 75 into the oil channel 74. In case of power failure, the valve 75 closes the oil channel 74 to thus prevent oil from being drawn into the vessel under evacuation whose vacuum is preserved by the closed outlet check valve 26.

The outlet of the oil channel 74 into the pump chamber 21 of the PV-stage is formed as a nozzle 76 and is oriented such that a direct connection to the suction side (inlet channel 24) is at all times blocked by the vane 22 of the PV-stage. By means of the nozzle 76 the quantity of the oil may be set which is drawn by the vacuum generated in the PV-stage.

From the oil conduit 74 there extends a branch 77 directly to an intermediate bearing formed by the opening zone 12 of the pump ring 8 and the rotor portion 14*b* where, during the operation of the pump, a pressure is set which is between the pressures of the HV-stage and the PV-stage. The oil admitted into the intermediate bearing 12, 14*b* flows into the HV-stage and the PV-stage as well. The quantity of oil admitted into the HV-stage is sufficient to provide it with the required lubrication. This oil is admitted into the PV-stage 11, 14*a* through the inlet channel 24.

The oil entering into the PV-stage passes, together with the pumped-out gas, through the outlet valve 26 and settles in the depression 27 which constitutes an intermediate oil sump and which is in communication with an oil conduit 78 (shown in dash lines in FIGS. 1 and 2) which, in turn, leads to further pump locations which are to be supplied with oil.

The oil conduit 78 which, in its initial portion, is formed of an approximately axially oriented bore 79, extends laterally in the pump housing 2 up to the shield 6. In the alternative, a laterally extending trough could be provided for guiding the oil to the shield 6. The axial bore 79 is adjoined by a transverse bore 81 which extends above the coupling 54 and the bearing for the stub shafts 52 and 53. The bore 81 terminates in a zone from which the oil may flow back into the main sump 3 having the oil level 72. The bores 78, 81 are inclined such that the oil flows from the intermediate sump 27 by gravity to the locations to be lubricated, such as a bearing housing 83 and a clutch housing 84 schematically shown in FIG. 3. The transverse oil bore 81 passes through—preferably in an inclined orientation—the pump housing 2 and communicates through the port 58 with the lubricating chamber 57 to be supplied with oil, above the stub shafts 52 and 53. Expediently, in this zone there is provided an axial groove 82 in the shield 6.

The oil is admitted through the bore 81 into the lubricating chamber 57. Excess oil flows further through the bore 81 and is admitted to the lower-lying main oil sump 3. From the lubricating chamber 57 the lubricating oil can at no time flow out entirely so that the bearings and clutch have, according to the invention, particularly good emergency running properties.

It will be understood that the above description of the present invention is susceptible to various modifications, changes and adaptations, and the same are intended to be comprehended within the meaning and range of equivalents of the appended claims.

What is claimed is:

1. A two-stage rotary vane vacuum pump comprising (a) means for defining a pre-vacuum stage including a pump rotor, a pre-vacuum pumping chamber and an outlet valve;

(b) means for defining a main oil sump;

(c) a first oil conduit having a first opening communicating with the main oil sump and a second opening communicating with said pre-vacuum pumping chamber; said first opening being located at a level below an operational level of oil in said main oil sump;

(d) means defining an intermediate oil sump situated at a level above said outlet valve and arranged for receiving oil from said pre-vacuum pumping chamber;

(e) a second oil conduit leading from said intermediate oil sump to components of the vacuum pump to be supplied with oil; said components being situated at a level below said intermediate oil sump;

(f) a motor having a motor shaft; said motor being situated adjacent said pump rotor;

(g) a shield separating said motor from said pump rotor; said shield having a throughgoing bore into which extend said rotor shaft and said motor shaft from opposite sides of the shield;

(h) shaft sealing rings supported in said shield and surrounding said rotor shaft and said motor shaft; said shaft sealing rings together defining a lubricant chamber forming part of said throughgoing bore;

said second oil conduit extending above said lubricant chamber and being in communication therewith; and (i) coupling means disposed in said lubricant chamber for connecting said motor shaft with said rotor shaft; said coupling means and said shaft sealing rings constituting at least some of said components of the vacuum pump.

2. A vacuum pump as defined in claim 1, further comprising solenoid valve means connected to said first oil conduit for shutting off said first oil conduit.

3. A vacuum pump as defined in claim 1, further comprising a bearing for rotatably supporting said pump rotor; and a branch conduit leading from said first oil conduit to said bearing.

4. A vacuum pump as defined in claim 1, further comprising a nozzle having an outlet constituting said second opening in said first oil conduit.

5. A vacuum pump as defined in claim 1, further comprising a pump housing forming part of said means defining said pre-vacuum stage; further wherein said second oil conduit comprises inclined bores provided in said pump housing.

6. A vacuum pump as defined in claim 1, wherein said throughgoing bore is defining by an inner wall of said shield; further comprising an axial groove provided in the inner wall in an upper portion of said lubricant chamber; said groove intersecting and communicating with said second oil conduit.

* * * * *